US009085849B2

(12) United States Patent
Takeuchi et al.

(10) Patent No.: US 9,085,849 B2
(45) Date of Patent: Jul. 21, 2015

(54) INK JET RECORDING APPARATUS

(71) Applicant: SEIKO EPSON CORPORATION, Tokyo (JP)

(72) Inventors: Hideyuki Takeuchi, Shiojiri (JP); Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/788,645

(22) Filed: Mar. 7, 2013

(65) Prior Publication Data

US 2013/0278694 A1 Oct. 24, 2013

(30) Foreign Application Priority Data

Apr. 18, 2012 (JP) ..... 2012-094479

(51) Int. Cl.
*B41J 2/01* (2006.01)
*D06P 5/30* (2006.01)
*B41J 3/407* (2006.01)

(52) U.S. Cl.
CPC . *D06P 5/30* (2013.01); *B41J 3/4078* (2013.01)

(58) Field of Classification Search
CPC ..... B41J 11/26; B41J 11/34; B41J 29/00; B41J 3/4078; D06P 5/30; B41F 15/16–15/38
USPC ..... 346/145; 101/474
See application file for complete search history.

(56) References Cited

U.S. PATENT DOCUMENTS

| | | | | |
|---|---|---|---|---|
| 5,090,313 | A * | 2/1992 | Chapman | 101/129 |
| 7,040,748 | B2 | 5/2006 | Niimi et al. | |
| 7,237,890 | B2 | 7/2007 | Niimi et al. | |
| 7,413,301 | B2 | 8/2008 | Niimi et al. | |
| 7,419,255 | B2 * | 9/2008 | Kawaguchi et al. | 347/102 |
| 2004/0179081 | A1 | 9/2004 | Nimi et al. | |
| 2006/0152568 | A1 | 7/2006 | Niimi et al. | |
| 2006/0170751 | A1 * | 8/2006 | Yokoyama et al. | 347/104 |
| 2006/0203069 | A1 | 9/2006 | Niimi et al. | |
| 2011/0242265 | A1 * | 10/2011 | Takahashi et al. | 347/263 |

FOREIGN PATENT DOCUMENTS

JP 2004-284305 10/2004

* cited by examiner

*Primary Examiner* — Shelby Fidler
*Assistant Examiner* — Tracey McMillion
(74) *Attorney, Agent, or Firm* — Workman Nydegger

(57) ABSTRACT

Provided is an ink jet recording apparatus including a tray detachably mounted on a tray support portion of an ink jet recording apparatus in which the tray includes a main body having a support surface to support a medium, two of a first positioning pin and second positioning pin which protrude toward a mounting surface on an opposite side of a setting surface of the main body and are used at the time of mounting the main body on the tray support portion, and the tray support portion includes two of a first hole portion and second hole portion in which the two positioning pins are inserted respectively, and a placing portion on which the tray is mounted in a state where the two positioning pins are inserted in the two hole portions.

5 Claims, 7 Drawing Sheets

INK JET RECORDING APPARATUS

BACKGROUND

1. Technical Field

The present invention relates to an ink jet recording apparatus used in a case of setting fabric, namely a material to be textile-printed, and an ink jet textile-printing apparatus which includes the ink jet recording apparatus and executes a textile printing (recording) by an ink jet system.

2. Related Art

An ink jet textile-printing apparatus which prints a desired image by discharging different colored ink on a surface of the fabric such as a T-shirt through an ink discharge head has been developed and widely used.

When the fabric on which printing is performed is set on such an ink jet textile-printing apparatus, a tray supported by a transport portion capable of transporting the tray toward a textile-printing execution area where the ink discharge head is located is used.

Furthermore, on the tray, a lengthy shaft portion for positioning which is used for positioning and fixing the tray with respect to a support portion of the transport portion is provided so as to protrude on the support portion side as shown in JP-A-2004-284305 described below.

However, if the lengthy shaft portion for positioning is provided in the tray as disclosed in JP-A-2004-284305, there is a problem in that attachment and detachment work of the tray against the support portion of the ink jet textile-printing apparatus is difficult.

Furthermore, in the case of JP-A-2004-284305, since the structure thereof is made to fix the tray to the support portion using a screw or the like after mounting the tray on the support portion, there is a problem in that the tray cannot be simply exchanged without tools. In other words, workability of exchanging the tray is poor.

Furthermore, in the case of JP-A-2004-284305, the tray is mounted by simply placing it on the support portion. Therefore, accuracy with respect to the positioning of the tray against the support portion is hardly considered.

SUMMARY

An advantage of some aspects of the invention is to perform a positioning of a tray, which is detachable, against a support portion with excellent accuracy by simply mounting the tray on the support portion.

According to an aspect of the invention, there is provided an ink jet recording apparatus including: an ink discharge portion which discharges ink on a medium; a tray support portion; and a tray detachably mounted on the tray support portion, in which the tray includes a main body having a setting surface to set a material to be textile-printed and two of a first positioning pin and a second positioning pin which protrude toward a surface on an opposite side of the setting surface of the main body and are used at the time of mounting the main body on the tray support portion, and the tray support portion includes two of a first hole portion and a second hole portion in which the two positioning pins are inserted respectively, and a support portion to support the tray in a state where the two positioning pins of the tray are inserted in the two hole portions.

In this case, "material to be textile-printed" means "cloth" which is a target to be textile-printed. The cloth includes natural fibers such as cotton, silk and wool, synthetic fibers such as nylon, or woven, knitted or non-woven fabric of composite fibers mixed with these fibers. Also, the cloth includes both lengthy material wound in a roll shape and material cut in a predetermined length. In addition, the cloth also includes clothing such as a sewed T-shirt, a sewed handkerchief, scarf, tower or the like, or cloth or the like to be cut or have been cut which is a part to be sewn.

Among the examples of the cloth, "material to be textile-printed" having a body portion in a tubular shape, such as a T-shirt, is a main target in the aspect of the invention.

According to the aspect of the invention, the tray includes the two first positioning pin and second positioning pin which are used at the time of mounting the main body on the support portion. The tray support portion includes the two first hole portion and second hole portion in which the two positioning pins are inserted. Therefore, by attaching the two positioning pins to the tray with excellent accuracy and providing the two hole portions in the tray support portion with excellent accuracy, positional accuracy of the tray with respect to directivity thereof is improved in a state where the tray is mounted on the tray support portion. Thereby, it is possible to perform a positioning of the tray against the tray support portion with excellent accuracy through merely mounting the tray capable of detaching on the tray support portion by placing it on a placing portion so as to insert the two positioning pins in the two hole portions.

Also, since the mounting is performed by simply placing the tray thereon, fixing work of fastening a screw, which is performed in the related art, is not necessary. Thereby, it is possible to improve the workability of exchanging the tray.

In the ink jet recording apparatus, it is preferable that the placing portion includes a biasing mechanism which biases the two positioning pins inserted in the hole portion in a predetermined direction.

Generally, a small gap, namely a gutter, is provided between the hole portion and the positioning pin to facilitate the insertion of the positioning pin.

According to the aspect of the invention, the unevenness of the mounting position of the tray which is generated by the gutter is automatically corrected by a biasing force of the biasing mechanism.

Therefore, it is possible to improve the workability at the time of mounting the tray and to perform the positioning of the tray against the support portion with excellent accuracy.

In the ink jet recording apparatus, it is preferable that the biasing mechanism is set such that a summed direction of a biasing direction of a biasing force at the first hole portion apart from a printing-start reference position and a biasing direction of a biasing force at the second hole portion closer to the printing-start reference position has a vector component toward the printing-start reference position.

According to the aspect of the invention, a resultant force of the biasing force operated to the tray has the vector component oriented to the printing-start reference position.

Therefore, when the tray is mounted on the support portion, it is possible to stably perform the positioning of the tray with respect to the printing-start reference position by the vector component of the resultant force. Thereby, it is possible to perform the printing with uniform quality without being influenced by the exchange of the tray.

In the ink jet recording apparatus, it is preferable that, in the biasing mechanism, a biasing direction of the biasing force at the first hole portion is a direction toward a reference line which is along a transport direction of the tray and passes the printing-start reference position, and a biasing direction of the biasing force at the second hole portion is a direction toward the printing-start reference position.

According to the aspect of the invention, the biasing direction of the biasing force at the second hole portion is a direction toward the printing-start reference position, and the biasing direction of the biasing force at the first hole portion is a direction toward the reference line which is along the transport direction of the tray and passes the printing-start reference position. Therefore, in a state where the tray is mounted on the support portion, it is possible to effectively realize the positioning of the tray with respect to the printing-start reference position with excellent accuracy. Thereby, it is possible to perform the printing with uniform quality.

Also, it is possible for the second hole portion closer to the printing-start reference position to function as a reference hole for positioning, and for the first hole portion apart from the printing-start reference position to function as a rotation preventive hole of the main body due to the biasing mechanism.

In the ink jet recording apparatus, it is preferable that, in the biasing mechanism, the biasing direction of each biasing force at the first hole portion and the second hole portion is a direction of coming close to the printing-start reference position.

According to the aspect of the invention, in a state where the tray is mounted on the support portion, it is possible to effectively realize the positioning of the tray with respect to the printing-start reference position with excellent accuracy, as similar to the above-described structure. Thereby, it is possible to perform the printing with uniform quality.

In the ink jet recording apparatus, it is preferable that the two first positioning pin and second positioning pin are disposed on a line along the transport direction of the tray, and the two first hole portion and second hole portion are disposed on the line along the transport direction of the tray, as well.

According to the aspect of the invention, since the alignment of the positioning of the tray against the support portion is performed based on the transport direction of the material to be textile-printed, it is easy to perform the positioning with excellent accuracy.

According to the aspect of the invention, the efficiency of ink jet recording work with respect to the ink jet textile-printing apparatus is improved, and the attachment and detachment work of the tray is facilitated.

Therefore, it is possible to smoothly execute the ink jet textile-printing with high quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
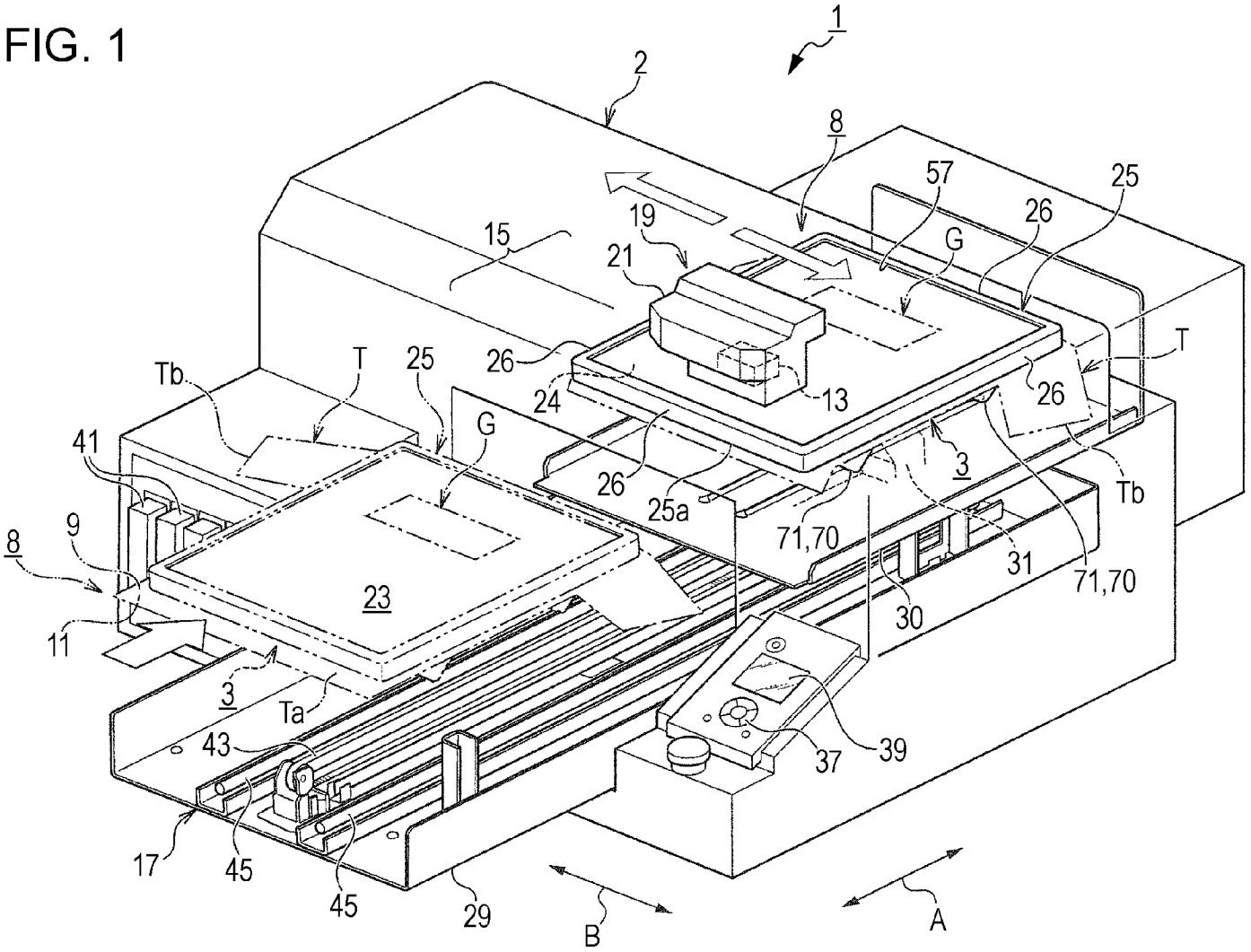
FIG. 1 is a perspective view showing a schematic configuration of an ink jet textile-printing apparatus mounted with a setting device for material to be textile-printed according to an example of the invention.
Figure 2:
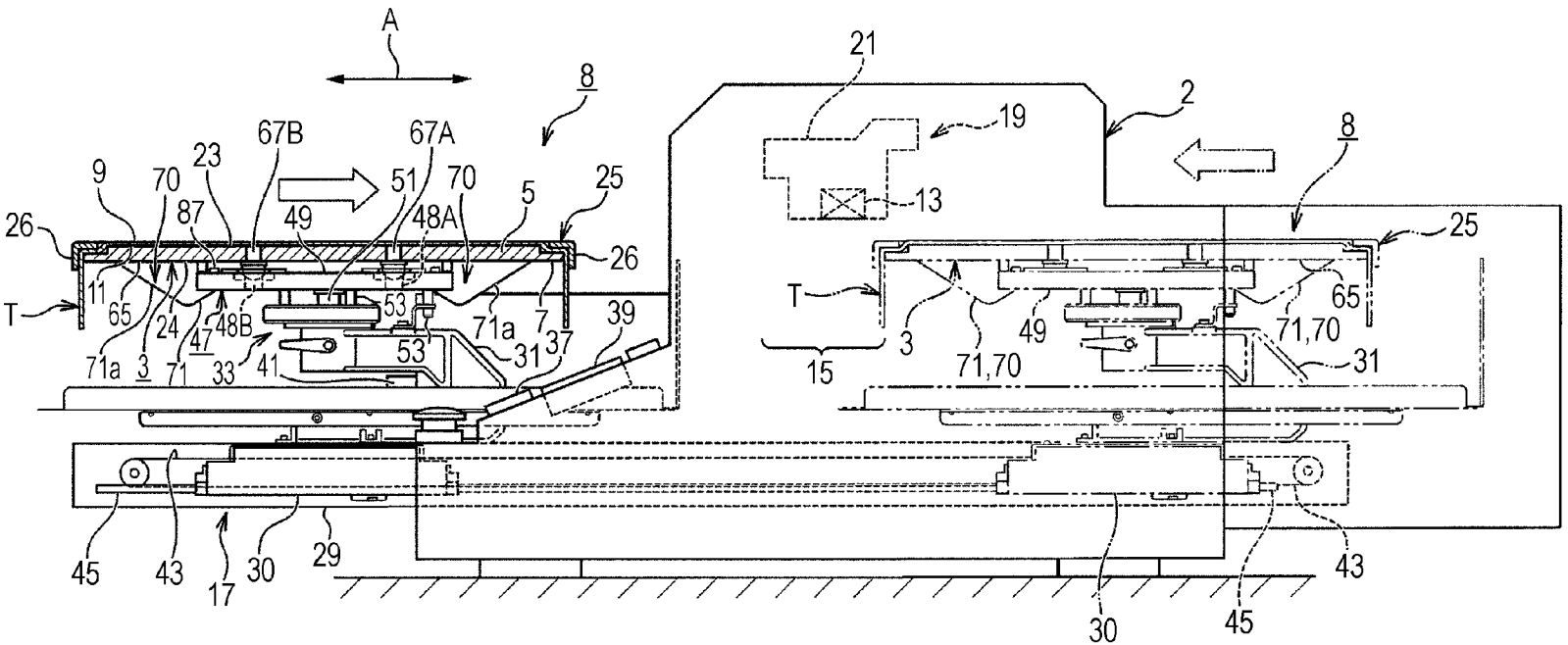
FIG. 2 is a cross-sectional side view showing the schematic configuration of the ink jet textile-printing apparatus mounted with the setting device for the material to be textile-printed according to the example.

First, an outline of the whole configuration of an ink jet textile-printing apparatus according to an example of the invention will be described with reference to FIGS. 1 and 2. Subsequently, the configuration and the operation of a setting device for a material to be textile-printed of the invention will be described by examples shown in FIGS. 3 to 10.

Furthermore, in the following description, "front side" of a tray 3 means the front side of the tray 3 in a transport direction A, namely the forward side which is the operating position side of the tray 3, and "rear side" of the tray 3 means the rear side of the tray 3 in a transport direction, namely the rear portion side of the tray 3.

In addition, in the following description, a T-shirt of which a body portion Ta and a sleeve portion Tb are formed in a sewn manner is exemplified as a material to be textile-printed (hereinafter, referred to as "fabric") T. The front surface of the T-shirt to be printed on which a printing image G is formed is designated as a first surface 9, and the back surface, which is on the opposite side of the first surface 9, to be supported is designated as a second surface 11.

An ink jet textile-printing apparatus 1 according to the example is an apparatus which includes a setting device 8 for the material to be textile-printed and executes a textile printing (recording) by an ink jet system. The setting device 8 includes a tray 3 configured detachably and a tray support portion 31.

In the examples, the configuration of the setting device 8 for the material to be textile-printed has a characteristic feature.

Furthermore, in the ink jet textile-printing apparatus 1 includes, besides the above-described setting device 8 (tray 3 and tray support portion 31) for the material to be textile-printed, various members constituting a transport portion 17 which transports the material to be textile-printed T set (supported) on the tray 3 along the transport direction A, and various members constituting the printing portion 19 which executes a printing process by discharging different colored ink on the first surface 9 of the material to be textile-printed T introduced in a textile-print execution area 15 by the transport portion 17.

The transport portion 17 includes a support base 29 extending along the transport direction A, a slider 30 reciprocating along the transport direction A on, for example, the center portion of the support base 29 in a width direction B, the tray support portion 31 which is equipped on the slider 30 and stands upward, a timing belt 43 to drive the slider 30, a motor (not shown) to drive the timing belt 43, and a guide rod 45 to guide the movement of the slider 30 in the transport direction A.

Also, an installation attachment 47 of the setting device 8 for the material to be textile-printed described below is provided on the tray support portion 31 via a connection mechanism 33. The tray 3 of the setting device 8 for the material to be textile-printed which will be described below is detachably mounted on the tray support portion 31 via the installation attachment 47.

The printing portion 19 includes a carriage 21 reciprocating in, as a moving direction thereof, the width direction B of an apparatus main body 2 intersecting with the transport direction A of the material to be textile-printed, and an ink discharge head 13 which is equipped on the carriage 21 and executes the printing process by discharging different colored ink on the first surface 9 of the material to be textile-printed T located in the textile-print execution area 15.

In addition, on a left side of the apparatus main body 2 seen from the front thereof (FIG. 1), an ink cartridge 41 to supply different colored ink toward the ink discharge head 13 is provided via an ink tube. The ink cartridge 41 is a constituting component of the printing portion 19 described above.

Furthermore, on a right side of the apparatus main body 2 seen from the front thereof, an operation button 37 to execute various operations of the ink jet textile-printing apparatus 1, and a display 39 to display a setting information or various of messages related to the ink jet textile-printing process are provided.

Examples

See FIGS. 3 to 10

The setting device 8 for the material to be textile-printed according to the example includes the tray support portion 31 of the ink jet textile-printing apparatus and the tray 3 detachably mounted on the tray support portion 31. Also, the tray 3 includes the main body 65 having the setting surface 23 to set the material to be textile-printed T, two of a first positioning pin 67A and second positioning pin 67B which protrude toward a mounting surface 24 on an opposite side of the setting surface 23 of the main body 65 and are used at the time of mounting the main body 65 on the tray support portion 31. In addition, the tray support portion 31 includes two of a first hole portion 48A and second hole portion 48B in which the two positioning pins 67A, 67B are inserted respectively, and a placing portion 50 on which the tray 3 is mounted in a state where the two positioning pins 67A, 67B are inserted in the two hole portions 48A, 48B.

More specifically, the tray 3 includes a main body 65 having a setting surface 23 to set the material to be textile-printed T, and the two first positioning pin 67A and second positioning pin 67B which are provided in the mounting surface 24 of the main body 65 and are used at the time of attaching the main body 65 to the tray support portion 31. The tray support portion 31 is equipped with the installation attachment 47 which has the two first hole portion 48A and second hole portion 48B in which the two first positioning pin 67A and second positioning pin 67B are inserted respectively, and an adjustment mechanism 87 to adjust a relative position (parallelism) of the placing portion 50 on which the tray 3 is placed.

In addition, the tray 3 is configured so as to be detachably set without using any fixing means with respect to the installation attachment 47 which is mounted on the tray support portion 31 in the apparatus main body 2 of the ink jet textile-printing apparatus 1 as described above.

Figure 3:
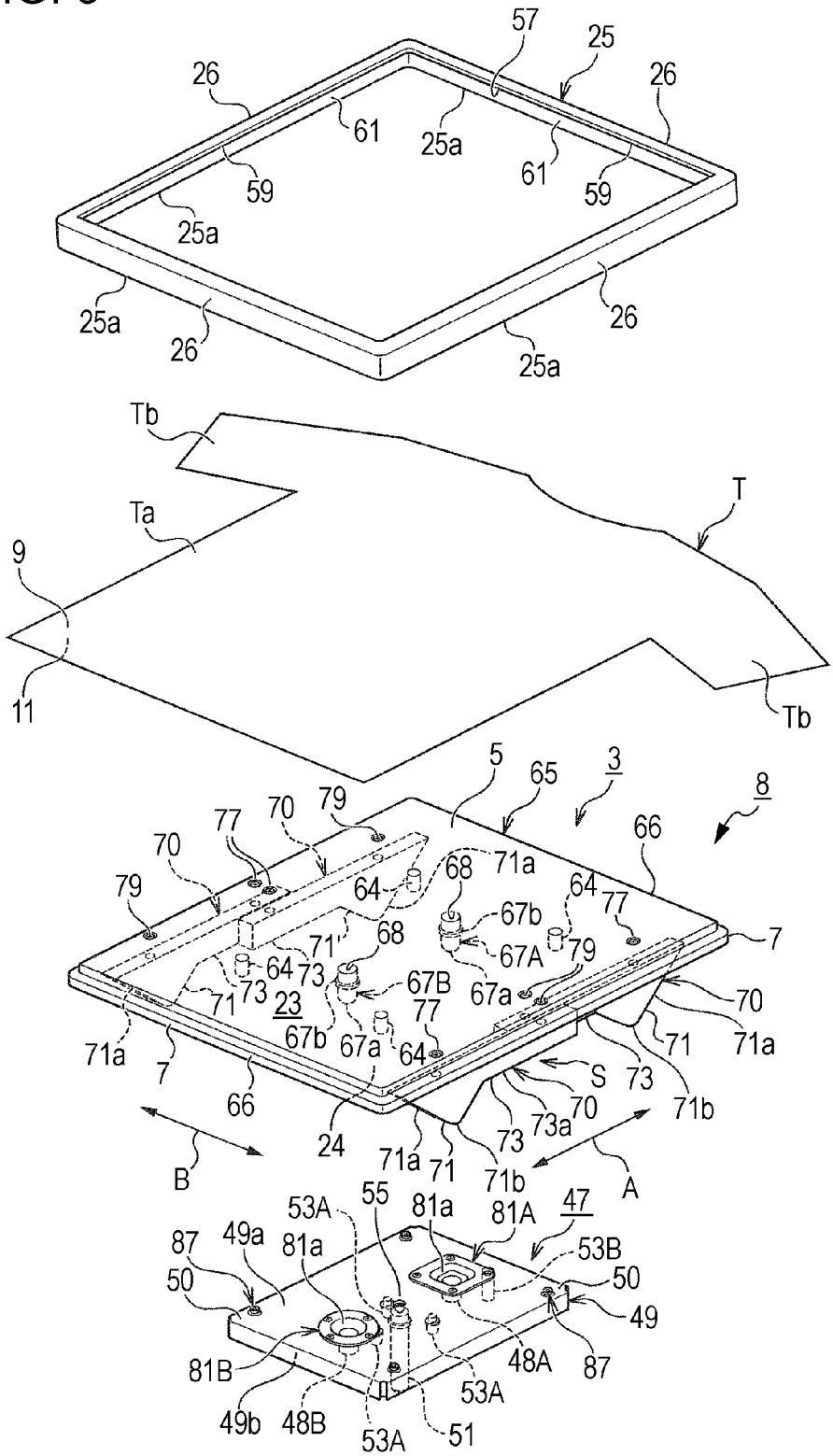
FIG. 3 is an exploded perspective view showing the setting device for the material to be textile-printed according to the example.

In addition, in the example, the main body 65 is a member in a rectangular plate shape having a round corner portion, for example, as shown in FIG. 3. Also, an engagement edge portion 7 which is formed thinner than a main body portion 5 in the center of the main body 65 and has an outer flange shape projecting outward in the horizontal direction is formed in the four surrounding sides of the main body 65.

Furthermore, an upper surface of the main body portion 5 of the main body 65 is the setting surface 23 to support the second surface 11 of the material to be textile-printed T from therebelow, and a lower surface of the main body portion 5 is the mounting surface 24 on which the installation attachment 47 described below is mounted.

Meanwhile, in the example, a fit-in type fixing frame 25 to hold the material to be textile-printed T in the main body 65 in a state of being aligned at a predetermined setting position, as shown in FIG. 3, is configured so as to be attached to the engagement edge portion 7 of the main body 65.

A window portion 57 having a rectangular window shape, for example, in which the main body portion 5 of the main body 65 fits is formed in the fixing frame 25. That is, the fixing frame 25 is constituted by the rectangular-frame shaped member of which four surrounding sides are enclosed by four frame elements 26 having an L-shaped cross-sectional shape, and center portion thereof is formed with the window portion 57.

Furthermore, an inner-flange shaped engagement step portion 59 facing the upper surface of the engagement edge portion 7 of the main body 65 described above, and a side plate portion 61 facing a side surface of the engagement edge portion 7 of the main body 65 described above are provided in each of four frame elements 26.

In addition, for example, two hole portions 68 to attach the positioning pins 67A, 67B described below thereto are formed in the center of the main body 65. In the vicinity of the two right and left sides of the main body 65 in the width direction B, four attachment holes 77 used for installing a leg unit 70 described below are formed at each of the right and left sides, for example. The array of the four attachment holes 77 is shifted each other by pair.

The positioning pins 67A, 67B provided in the mounting surface 24 of the main body 65 are a circular cross-sectional shaped shaft member of which a tip end 67*a* is round in a spherical shape and the diameter and length are thick and short, for example.

Incidentally, an outer flange portion 67*b* is formed in the middle of the positioning pins 67A, 67B. The part on a base end side below the outer flange portion 67*b* is inserted in a hole portion 68 formed in the center of the main body 65.

A leg portion 71 is constituted by a plate-shaped member having a triangular shape when seen from the side thereof, and is positioned more inner side than an edge portion 66 on a mounting side of the main body 65. Also, an inclined surface on an outer side of the leg portion 71 is used as a guide inclined surface 71*a* to guide the movement of the material to be textile-printed T which is mounted by a edge portion 66 on the mounting side.

In addition, in the example, a square-bar shaped member is formed so as to extend from the inclined surface on the inner side of the leg portion 71 to the inner side of the setting device 8. The square-bar shaped member is configured so as to function as a grip portion 73 used for grabbing the tray 3 by hand when carrying it.

Figure 4:
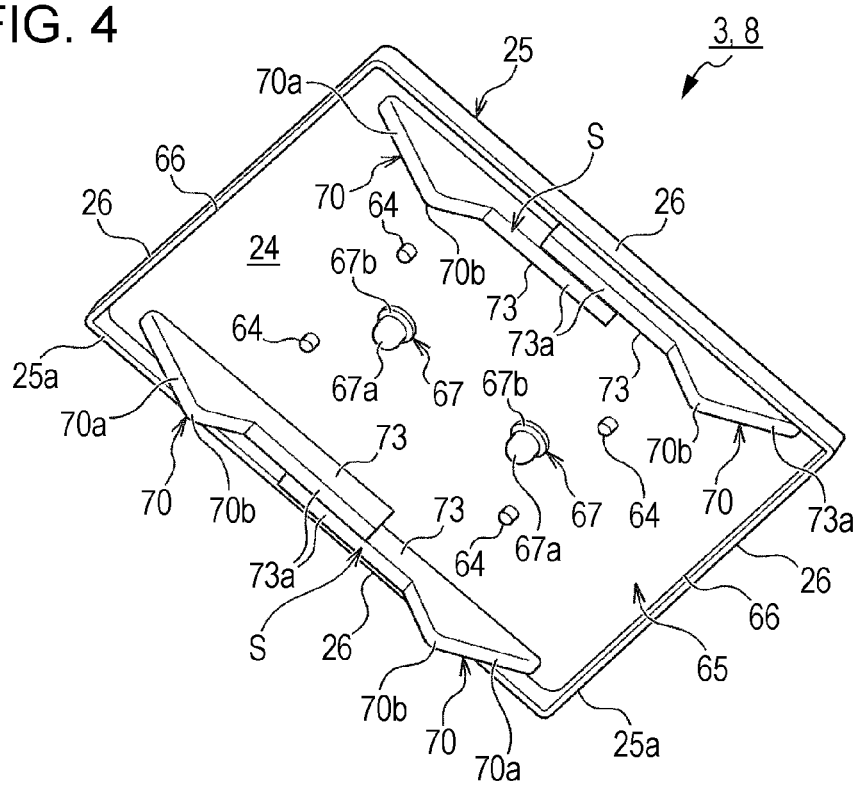
FIG. 4 is a perspective view showing a tray of the setting device for the material to be textile-printed according to the example, seen from the diagonal downward.
Figure 5:
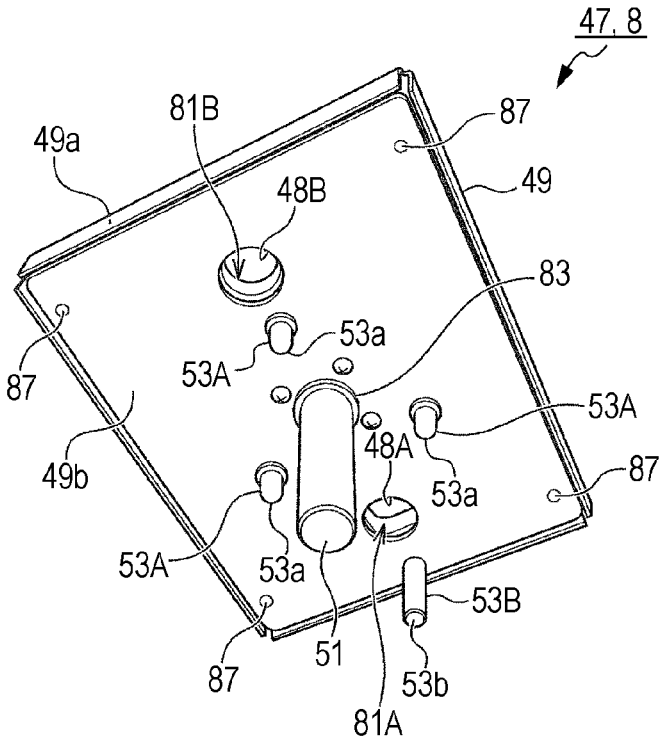
FIG. 5 is a perspective view showing an installation attachment of the setting device for the material to be textile-printed according to the example, seen from the diagonal downward.

In addition, the leg portion 71 is configured so as to, when the tray 3 configured above is horizontally put on a planar portion such as a desk, form a space S to enter operator's hands between the grip portion 73 and the planar portion (see FIG. 4).

Furthermore, the leg portion 71 is configured such that, when the tray 3 on which the fixing frame 25 is attached is horizontally put on the planar portion, a lower surface 73*a* of the grip portion 73 is positioned closer to the planar portion side than a lower surface 25*a* of the fixing frame 25.

A screw hole is provided on the upper surface side of the leg unit 70 in which the leg portion 71 and the grip portion 73 are integrally formed.

By screwing a fixing screw 79, which is inserted from the upper portion of the attachment hole 77 formed in the vicinity of the two right and left sides of the main body 65 in the width direction B, to the screw hole, for example, four leg units 70 are symmetrically attached at a predetermined position of the mounting surface 24 of the main body 65.

In addition, four support protrusions 64 which, when the tray 3 is mounted on the installation attachment 47 described below, regulate the attitude of the tray 3 with respect to the ink discharge head 13 through horizontally supporting the main body 65 by being in contact with the placing portion 50 are provided on the mounting surface 24 of the main body 65. Furthermore, in a state where the tray 3 is mounted on the installation attachment 47, the support protrusion 64 is disposed at a position near the adjustment mechanism 87 of the installation attachment 47.

Figure 6:
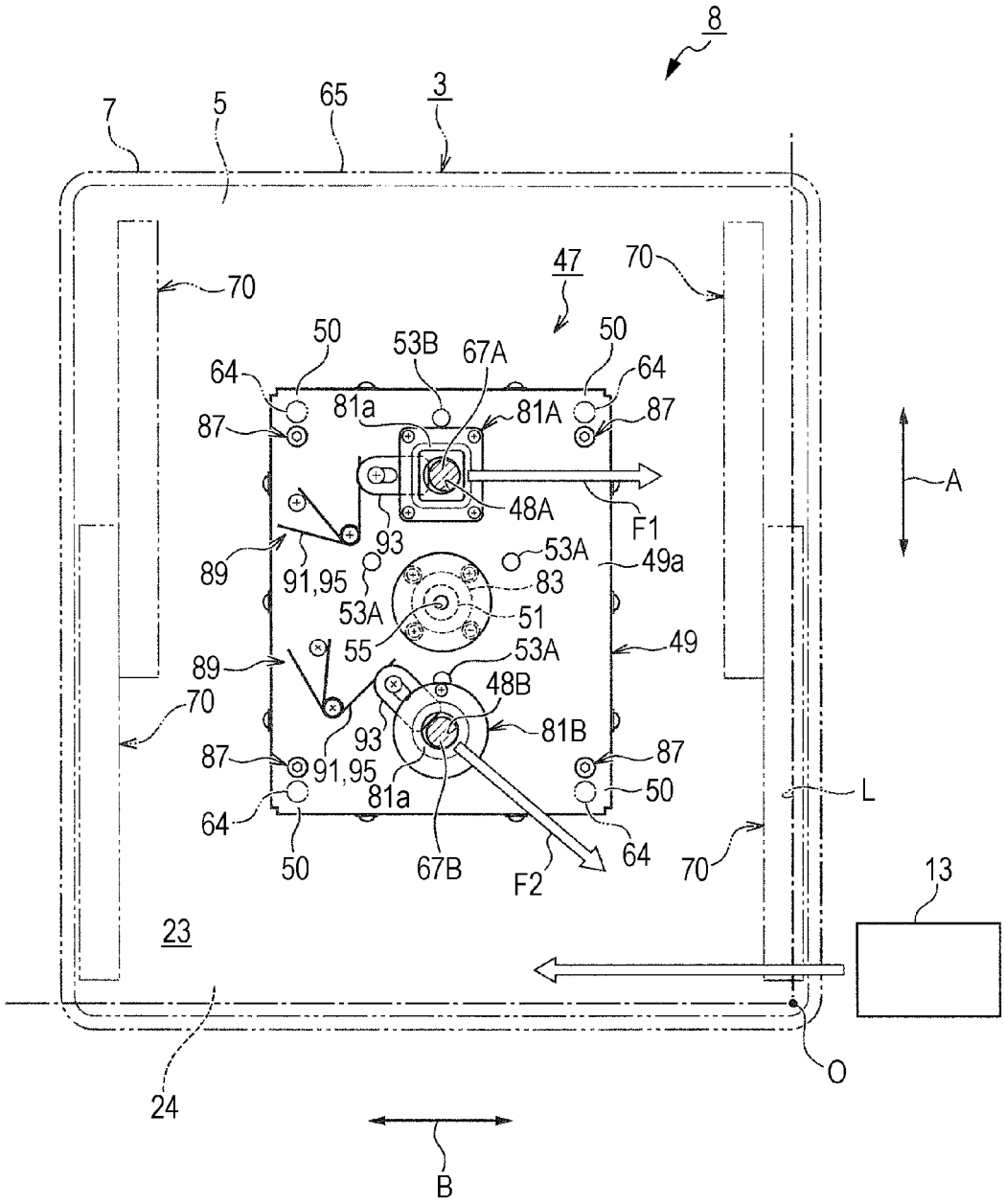
FIG. 6 is a plan view showing the setting device for the material to be textile-printed according to the example.

Four placing portions 50 corresponding to the support protrusions 64 of the tray 3 are provided in the installation attachment 47, as shown in FIG. 6. Also, four adjustment mechanisms 87 which correspond to the placing portions 50 and adjust the relative position, namely the parallelism, of each placing portion 50 are provided in the installation attachment 47. The placing portion 50 is provided at nearby positions on the forward and rearward of the adjustment mechanisms 87 which are provided at the four corner portions of the installation attachment 47.

In the case of mounting the tray 3 on the installation attachment 47, the parallelism of each placing portion 50 is adjusted using the adjustment mechanism 87 of the installation attachment 47, and then the tray 3 is mounted on the installation attachment 47 such that the support protrusion 64 of the tray 3 is in contact with the placing portion. At this time, the four support protrusions 64 are disposed at a position near each adjustment mechanism 87. Therefore, it is possible to mount the tray 3 on the installation attachment 47 in a state where the parallelism of each placing portion 50, namely the position of the placing portion 50 with respect to the ink discharge head 13, is regulated.

In a state where the tray 3 is mounted on the installation attachment 47, the distance from the support protrusion 64 to the closest corner portion of the main body 65 becomes shorter than that of the three-point supporting type tray in a related art. Therefore, it is possible to suppress the deformation or sagging of the corner portion in a vertical downward direction caused by the weight of the main body 65 or an external pressure (a load of cloth or an external force due to user's erroneous operation, for example). Thereby, a stability of the horizontal attitude of the main body 65 is improved.

Specifically, the installation attachment 47, which is used for installing the tray 3 configured as above on the tray support portion 31 of the apparatus main body 2, includes a installation plate 49, a shaft portion for positioning 51 protruding from the center of the installation plate 49 toward the tray support portion 31 side of the apparatus main body 2, and the adjustment mechanism 87 described above. The installation plate 49 is formed with the two first hole portion 48A and second hole portion 48B in which the two first positioning pin 67A and second positioning pin 67B provided in the mounting surface 24 of the tray 3 are inserted.

In the example shown in the drawings, four positioning pins 53A, 53B in total are disposed on the circumference of the shaft portion for positioning 51 and a central rear portion side. The installation attachment 47 is mounted on the tray support portion 31 using the four positioning pins 53A, 53B and the shaft portion for positioning 51 via the connection mechanism 33.

The installation plate 49 is a flat rectangular-housing shaped member smaller than the main body 65 of the tray 3, and is configured by appropriately bending a metal plate material, for example.

Shaft bush members 81A, 81B to support the two first positioning pin 67A and second positioning pin 67B which are protruding from the mounting surface 24 on the tray 3 are attached on the upper surface side of the installation plate 49 where the tray 3 is mounted. Guide inclined surfaces 81*a*, 81*a* which have a downwardly tapered shape and guide the insertion of the first positioning pin 67A and the second positioning pin 67B are formed in an insertion-side opening portion of each of the shaft bush members 81A, 81B. In addition, the first fitting hole portion 48A and the second fitting hole portion 48B are formed so as to penetrate from an bottom end portion of each of the guide inclined surfaces 81*a*, 81*a* to the lower surface of the installation plate 49.

In the center of the lower surface of the installation plate 49 which is installed on the tray support portion 31, the circular cross-sectional shaped shaft portion for positioning 51 and having a thick diameter and long length is provided so as to protrude to the tray support portion 31 side.

A base end portion of the shaft portion for positioning 51 is supported by, for example, a shaft bush member 83 accommodated in the installation plate 49. Also, the shaft portion for positioning 51 is attached to the installation plate 49 by tightening a fixing bolt inserted from a hole portion 55 formed in the center of the upper surface side of the installation plate 49.

Furthermore, the three positioning pins 53A provided around the shaft portion for positioning 51 are rod-shaped members having a smaller diameter and a shorter length compared the shaft portion for positioning 51. Also, a tip end 53*a* of each positioning pin 53A has a spherical shape, for example. Meanwhile, the positioning pin 53B on the rear portion side of the installation plate 49 is a rod-shaped member having a small diameter and a long length, and a top end 53*b* thereof is chamfered, for example.

Furthermore, in the example, the two first positioning pin 67A and second positioning pin 67B and the two first hole portion 48A and second hole portion 48B are disposed at the position shifted each other in the transport direction A of the tray 3.

Specifically, the two first positioning pin 67A and second positioning pin 67B and the two first hole portion 48A and second hole portion 48B are appropriately spaced apart from each other and disposed on a line which is along the transport direction A and passes the center of the tray 3 and the installation attachment 47 in the width direction B.

As a characteristic configuration of the invention, a gutter, namely a gap, (not shown) is formed between the two hole portions 48A, 48B and the two positioning pins 67A, 67B, and a biasing mechanism 89 which draws aside (bias) the two positioning pins 67A, 67B in a predetermined direction is provided in the installation attachment 47.

The biasing mechanism 89 is configured of including a biasing member 95 which includes a biasing spring 91 constituted by, for example, a torsion coil spring biasing the two positioning pins 67A, 67B in a predetermined direction, and a slide pressing piece 93 which presses the two positioning pins 67A, 67B in a predetermined direction through receiving a biasing force F of the biasing spring 91.

In addition, the biasing direction of the biasing member 95 is set such that a summed force of a vector component of a biasing force F2 at the second hole portion 48B closer to the printing-start reference position O and a vector component of a biasing force F1 at the first hole portion 48A apart from the printing-start reference position O has a vector component toward the printing-start reference position O.

Specifically, in the example shown in FIG. 6, the biasing direction of the biasing member 95 at the second hole portion 48B is set to the diagonal forward direction toward the printing-start reference position O, and the biasing direction of the biasing member 95 at the first hole portion 48A is set to the lateral direction toward a reference line L which is along the transport direction A of the tray 3 and passes the printing-start reference position O.

Also, in the example, the second hole portion 48B is used as a reference hole for positioning which determines the setting position of the tray 3, and the first hole portion 48A is used as a rotation prevention hole to prevent the rotation of the tray 3 due to the biasing mechanism 89.

In accordance with this, in the example, the second hole portion 48B is formed in a hole portion shape having a round hole shape with a small gutter, and the first hole portion 48A is formed in an elongated hole shape having a enlarged gutter in one direction on the plane thereof or formed in a square hole shape having enlarged gutters in two direction on the plane thereof.

Figure 7:
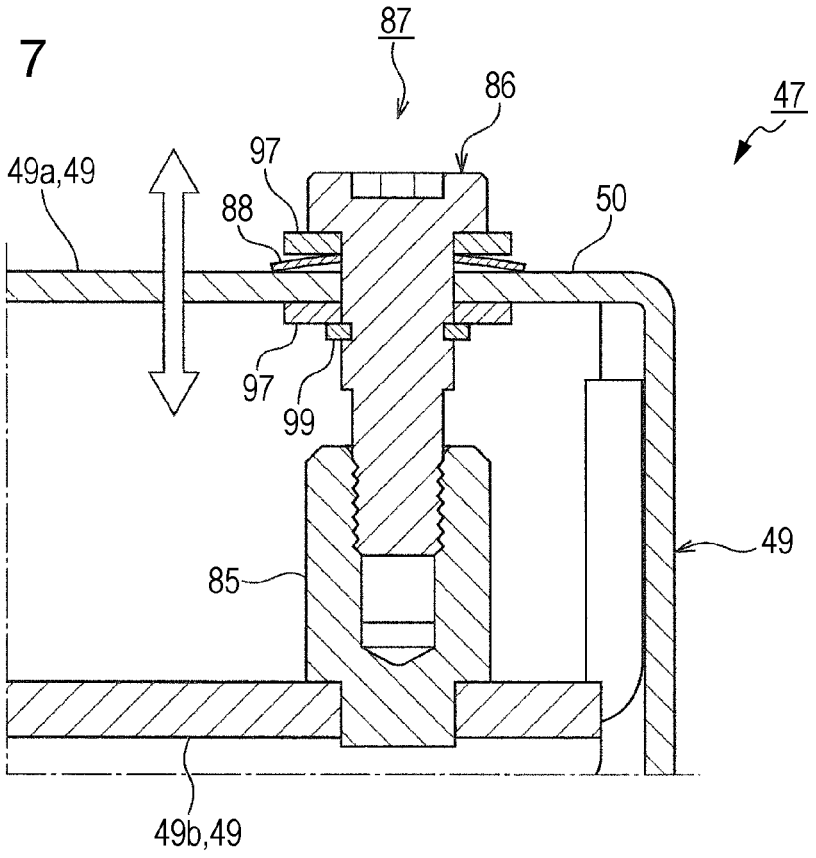
FIG. 7 is an enlarged longitudinal cross-sectional view showing the periphery of an adjustment mechanism of the installation attachment of the setting device for the material to be textile-printed according to the example.

In addition, in the example, the screw type adjustment mechanism 87 shown in FIG. 7 is employed as the adjustment mechanism 87. The adjustment mechanism 87 includes a nut portion 85 attached to a bottom plate portion 49*b* of the installation plate 49 in a fixed state, an adjustment bolt 86 which includes a shaft portion which is inserted from an upside of a top plate portion 49*a* of the installation plate 49 and screwed into the nut portion 85, plane washers 97, 97 which are arranged above and below the top plate portion 49*a* and interpose it therebetween, a disc spring 88 arranged between the two plane washers 97, 97, and an E-ring 99 which supports a lower surface of the plane washer 97 therebelow and is attached to the shaft portion of the adjustment bolt 86 as a retaining ring.

Four of the adjustment mechanisms 87 configured as above are provided at a vicinity of the corner portion of the installation attachment 47 as described above. The adjustment of the relative position, namely the parallelism, of the each placing portion 50 of the installation attachment 47 is performed by appropriately adjusting the adjustment bolts 86 of the four adjustment mechanisms 87.

The aspect of the biasing direction of the first positioning pin 67A and second positioning pin 67B by the biasing member 95, and the installation aspect of the first positioning pin 67A and second positioning pin 67B and the first hole portion 48A and second hole portion 48B are not limited to the aspect described above. Also, various modifications are possible including the aspects shown in FIGS. 8 to 10.

Figure 8:
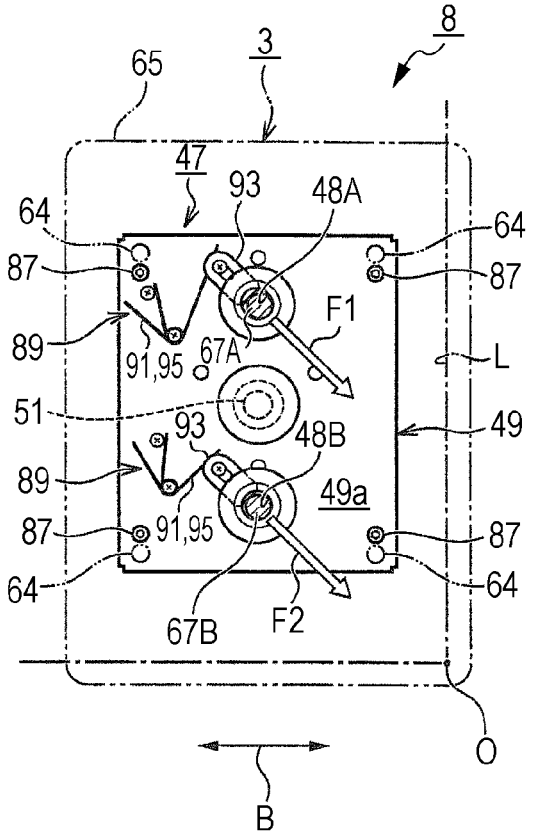
FIG. 8 is a plan view showing another aspect of the biasing direction of a positioning pin and the arrangement of the positioning pin and a hole portion of the setting device for the material to be textile-printed according to the example.

Among the aspects, the aspect shown in FIG. 8 is set so as to make the biasing direction of the biasing members 95 the same at both of the first hole portion 48A and the second hole portion 48B, whereby both of them are oriented to the printing-start reference position O.

Figure 9:
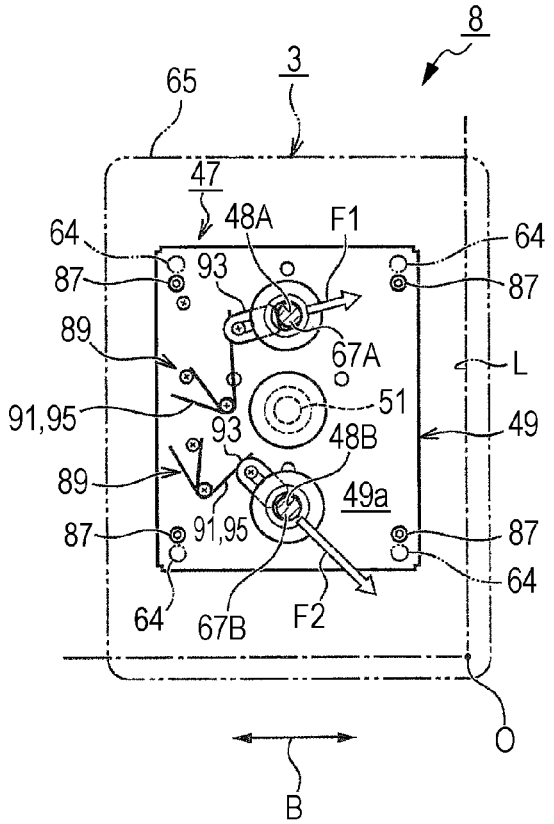
FIG. 9 is a plan view showing another aspect of the biasing direction of the positioning pin and the installation of the positioning pin and a fitting hole portion of the setting device for the material to be textile-printed according to the example.

Furthermore, in the aspect shown in FIG. 9, the biasing direction of the biasing member 95 at the first hole portion 48A is set so as to be away from the printing-start reference position O, but the magnitude of the biasing force F1 is small. Thereby, the biasing force F1 is drawn by the biasing force F2 at the second hole portion 48B which is oriented to the printing-start reference position O. As a result, the summed vector component of the two biasing forces F1, F2 is configured so as to have a component oriented to the printing-start reference position O.

Figure 10:
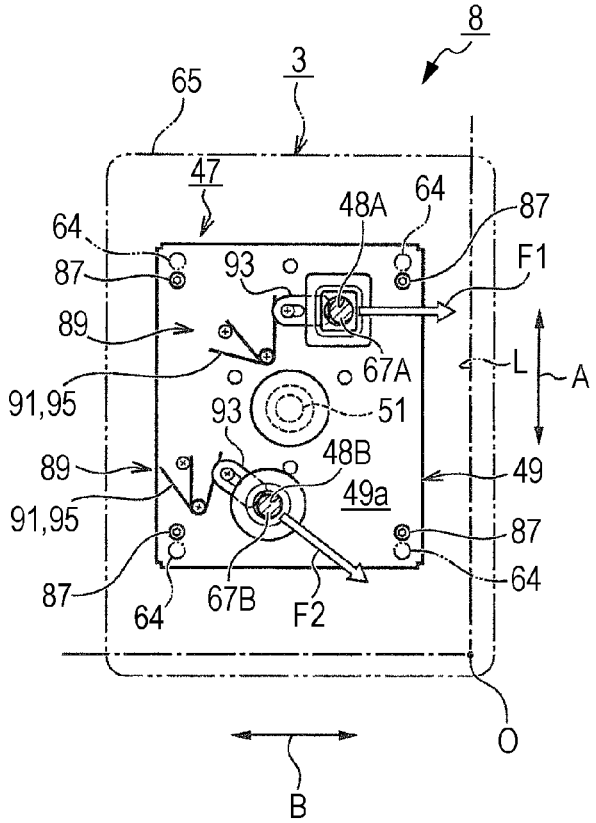
FIG. 10 is a plan view showing another aspect of the biasing direction of the positioning pin and the installation of the positioning pin and the fitting hole portion of the setting device for the material to be textile-printed according to the example of the invention.

In addition, the installation aspect in which the two first positioning pin 67A and second positioning pin 67B and the first hole portion 48A and second hole portion 48B are not on the same line along the transport direction A of the tray 3 but on the position shifted each other in the width direction B of the tray 3 is shown in FIG. 10. Also in this case, it is possible to perform the positioning of the tray 3 against the tray support portion 31 with excellent accuracy by adjusting the applying manner of the biasing forces F1, F2 of the biasing member 95.

Next, the operation aspect of the setting device 8, which are configured as above, for the material to be textile-printed of the example will be described. First, the tray 3 is put on the planar portion such as a desk, and then the material to be textile-printed T on which the ink jet textile-printing is performed is set on the tray 3. Subsequently, the fixing frame 25 described above is fit in the tray 3, whereby the material to be textile-printed T is set on the tray 3.

Next, the tray 3 on which the material to be textile-printed T is set is carried, by gripping the grip portion 73, to the setting area where the tray support portion 31 of the ink jet textile-printing apparatus 1 stands by. Then the tray 3 is mounted on the installation attachment 47 where the tray support portion 31 is mounted.

In this case, an operator inserts the first positioning pin 67A in the first hole portion 48A in the manner of that the guide inclined surface 81*a* of the shaft bush member 81A of the installation attachment 47 guides the first positioning pin 67A protruding downward from the mounting surface 24 of the main body 65 of the tray 3. The other second positioning pin 67B is inserted in the second hole portion 48B in the manner of being guided by the guide inclined surface 81*a* of the shaft bush member 81B of the installation attachment 47. The setting work of the tray 3 is completed by following this simple process.

In other words, the first positioning pin 67A inserted in the first hole portion 48A and the second positioning pin 67B inserted in the second hole portion 48B are automatically drawn aside in a predetermined direction by respectively receiving the biasing forces F1, F2 from the biasing member 95. Thereby, it is possible to perform the positioning of the tray 3 against the tray support portion 31 with excellent accuracy.

In addition, the parallelism of the installation attachment 47 is adjusted in advance by the adjustment mechanism 87 described above, and the parallelism of the tray 3 installed on the tray support portion 31 is maintained by the support protrusions 64 supporting tray 3 at four points via the installation attachment 47.

Another Example

Although the setting device 8 for the material to be textile-printed and the ink jet textile-printing apparatus 1 according to the invention is basically configured as above, it is also possible to partially change or omit the configuration unless departing from the scope of the invention.

For example, the biasing mechanism 89 is not limited to the mechanism employed in the example described above which uses the biasing member 95 employing a torsion coil spring as the biasing spring 91, the configuration where the hole portions 48A, 48B themselves have a guide function which is performed by the positioning pins 67A, 67B in the example described above may be possible. Also, the biasing mechanism 89 may use the weight of the tray 3, an electromagnet or the like. Furthermore, it is also possible to use a compression coil spring instead of the torsion coil spring. In addition, it may be possible to employ not only the configuration where both of the positioning pins 67A and 67B are provided with the biasing mechanism 89 but also at least one of the positioning pins 67A and 67B is provided with the biasing mechanism 89.

The adjustment mechanism 87 provided in the installation attachment 47 is not limited to the screw type adjustment mechanism 87 employed in the example described above, it may be possible to employ a dial-adjustment type adjustment mechanism 87 using a worm gear, a cam mechanism or the like.

The adjustment bolt 86 employed in the example may be configured to be able to perform the adjustment on the lower surface side of the installation attachment 47 such that the tray 3 can be adjusted even in a state of being set on the installation attachment 47.

Furthermore, it is not necessary for all of the top plate portions 49*a* in the installation plate 49 of the installation attachment 47 to be on a horizontal plane, a stepped portion, an inclined portion, a hole portion or the like may be formed in a part of the top plate portion 49*a* as long as, at least, the parallelism of the placing portion 50 on which the support protrusion 64 provided in the mounting surface 24 of the main body 65 of the tray 3 abuts is maintained.

Also, in the example described above, the tray 3 moves in the transport direction A and the ink discharge head 13 moves in the width direction B only. However, without being limited thereto, the configuration where the position of the tray 3 is fixed, and the ink discharge head 13 moves in the transport direction A and the width direction B may be employed. Alternatively, both of the tray 3 and the ink discharge head 13 may relatively move each other.

In the example described above, a serial type ink jet head is exemplified as the ink discharge head 13, but a line type ink jet head may be employed as well.

In the example described above, cloth is exemplified as the material to be textile-printed. However, without being limited thereto, a medium such as paper, lumber or film may be used as well.

The entire disclosure of Japanese Patent Application No. 2012-094479, filed Apr. 18, 2012 is expressly incorporated by reference herein.

What is claimed is:

1. An ink jet recording apparatus comprising:

an ink discharge portion that discharges ink on a medium;

a tray that includes a main body having a support surface to support the medium while the ink is being discharged onto the medium, and a first positioning pin and a second positioning pin which protrude toward a surface on an opposite side of the support surface of the main body; and a tray support portion that includes a first hole portion and a second hole portion in which the two positioning pins are inserted, and a support portion supporting the tray in a state where the two positioning pins are inserted in the two hole portions, wherein the tray support portion includes a biasing mechanism which biases the two positioning pins inserted in the two hole portions in a predetermined direction, wherein, in the biasing mechanism, a summed force of a biasing force with respect to the first positioning pin at the first hole portion and a biasing force with respect to the second positioning pin at the second hole portion which, compared to the first hole portion, is closer to a recording-start reference position is set so as to have a vector component toward the recording-start reference position.

2. The ink jet recording apparatus according to claim 1, wherein, in the biasing mechanism, a biasing direction of the biasing force with respect to the first positioning pin at the first hole portion is a direction toward a reference line which is along a transport direction of the tray and passes the printing-start reference position, and a biasing direction of the biasing force with respect to the second positioning pin at the second hole portion is a direction toward the printing-start reference position.

3. The ink jet recording apparatus according to claim 1, wherein, in the biasing mechanism, the biasing direction of each biasing force at the first hole portion and the second hole portion is a direction of coming close to the printing-start reference position.

4. The ink jet recording apparatus according to claim 1, wherein the first hole portion and the second hole portion are disposed on a line along the transport direction of the tray.

5. The ink jet recording apparatus according to claim 1, further comprising:

a frame member configured to hold the medium on the support surface.

* * * * *